US006575550B1

(12) United States Patent
Steinfield

(10) Patent No.: US 6,575,550 B1
(45) Date of Patent: Jun. 10, 2003

(54) DETERMINING PERFORMANCE OF A FLUID EJECTION DEVICE

(75) Inventor: Steven W. Steinfield, San Diego, CA (US)

(73) Assignee: Hewlett-Packard Development Company, Houston, TX (US)

( * ) Notice: Subject to any disclaimer, the term of this patent is extended or adjusted under 35 U.S.C. 154(b) by 0 days.

(21) Appl. No.: 10/060,448

(22) Filed: Jan. 30, 2002

(51) Int. Cl.[7] ..... B41J 2/01
(52) U.S. Cl. ..... 347/19
(58) Field of Search ..... 347/19, 37, 7, 347/5

(56) References Cited

U.S. PATENT DOCUMENTS 6,315,383 B1 * 11/2001 Sarmast et al. ..... 347/19

* cited by examiner

*Primary Examiner*—Craig Hallacher

(57) ABSTRACT

Performance of a fluid ejection device is ascertained by using an array of fluid responsive transducers which provide signals useful for determining the size and/or landing position of ejected fluid droplets to obtain useful data for controlling fluid ejection devices such as inkjet printheads.

22 Claims, 3 Drawing Sheets

$$X = \text{CENTROID} = \left[ \sum_{\substack{C=\text{COLUMN}\\ \text{COORDINATE 1}}}^{\substack{C=\text{COLUMN}\\ \text{COORDINATE N}}} \left\{ C * \left[ \sum_{\text{ROW}=1}^{\text{ROW}=N} (\text{PIXEL VALUE}) \right] \right\} \right] \Big/ \left[ (\text{AREA}/(\text{MAX. GRAYSCALE VALUE}) \right]$$

$$Y = \text{CENTROID} = \left[ \sum_{\substack{C=\text{ROW}\\ \text{COORDINATE 1}}}^{\substack{C=\text{ROW}\\ \text{COORDINATE N}}} \left\{ R * \left[ \sum_{\text{COLUMN}=1}^{\text{COLUMN}=N} (\text{PIXEL VALUE}) \right] \right\} \right] \Big/ \left[ (\text{AREA}/(\text{MAX. GRAYSCALE VALUE}) \right]$$

| | C1 | C2 | C3 | C4 | C5 |
|---|---|---|---|---|---|
| R1 | 0 | 79 | 102 | 87 | 0 |
| R2 | 77 | 238 | 255 | 254 | 118 |
| R3 | 104 | 255 | 255 | 255 | 197 |
| R4 | 81 | 251 | 255 | 255 | 129 |
| R5 | 0 | 109 | 146 | 119 | 10 |

← EXAMPLE

SPOT AREA= (SUM OF ALL GRAYSCALE VALUES)/255=14.24 PIXELS^2
SPOT DIAMETER=2*SQRT[(AREA/ PL)]= 4.26 PIXELS
X CENTROID = WEIGHTED AVERAGE COLUMN POSITION:
[1*(0+77+104+81+0)
+2*(79+238+255+251+109)
+3*(102+255+255+255+146)
+4*(87+254+255+255+199)
+5*(0+118+197+129+10)]/(AREA *255)
=COLUMN 3.12 (CENTER OF COLUMN 3 + 0.12 PIXELS)
Y CENTROID = WEIGHTED AVG ROW POSITION = ROW 3.07
(CENTER OF ROW 3+0.07 PIXELS)
→SPOT IS 4.26 PIXELS IN DIAMETER, LOCATED AT (3.12, 3.07)
NOTE THAT EFFECTIVE POSITIONAL RESOLUTION IS ENHANCED BY A FACTOR RELATED TO # GRAY LEVEL/PIXEL.

*FIG. 3*

DETERMINING PERFORMANCE OF A FLUID EJECTION DEVICE

BACKGROUND OF THE INVENTION

The present invention relates to the determination of size and/or landing position of droplets of fluid ejected from a fluid ejection device. Some examples of various types of fluid ejection devices include inkjet printheads, medical devices, fuel injectors and other applications where droplets are to be forcefully ejected from a device such as a piezo-electric, thermal or any other fluid droplet ejector under controlled conditions. For convenience embodiments will be described with reference to inkjet printers which typically use thermal or piezo-electric means to forcefully eject ink droplets through microscopic orifices onto media on which printing is to take place.

Inkjet printers are of various types including those on which one or more inkjet printheads, also known as pens, are mounted on a scanning carriage and others in which the printheads may be mounted in stationary position on a frame for so-called page-wide-array (PWA) printing. Scanning or reciprocating inkjet printers ordinarily have a printhead servicing station located at some point on the path of travel of a printhead carriage, typically to one side or the other of the print area, so that the scanning carriage and associated printheads thereon can be moved to the service station for spitting, priming, wiping, capping or otherwise servicing the printhead orifices. The servicing station may include printhead wipers, a source of printhead servicing fluid and printhead caps, some or all of which may be mounted in a stationary position or on a sled or other moveable support to bring the printheads to be serviced and the service station components into and out of operating proximity to each other for servicing. Inkjet printers with stationary printheads or pens which also may require periodic servicing may employ such a sled or moveable support to bring the service station to the stationary printheads when servicing of the printhead orifices is required.

In the art of inkjet printing, the accuracy of placement of the individual ink droplets which form the printed image is typically tested by printing a test pattern of droplets onto the print media and visually selecting the best-matched pattern (s). In automatic systems, printed test sheets are evaluated by optically measuring the position of selected points of the printed pattern for comparison with stored data representative of the desired position of selected points of the pattern to generate printhead error correction control signals to adjust the firing of ink from the various orifices of the pen. Known methods for doing so involve detecting the landing positions or sizes of the individual droplets after they have been printed onto a sheet of test media and have the disadvantage that the process interrupts printing, wastes media and takes several seconds, because the steps of printing and measuring are done in series. In high speed printers, every second is critical to system throughput and, in addition, the accuracy of photo-sensors used to detect position and size of droplets is dependent not only upon the type of photosensor used but also upon the media type. Furthermore, sensor reliability may degrade as ink and/or ink aerosol accumulates in the sensor window.

Other earlier techniques include real time optical measurement of the in-flight trajectory of the inkjet droplets from at least two different directions orthogonal to the direction of droplet flight, in order to calculate true trajectory to develop printhead error correction control signals. This type of apparatus is very expensive and is typically used only in a controlled or test environment.

Low cost ink drop sensing techniques are disclosed in U.S. Pat. No. 6,086,190 issued Jul. 11, 2000 to Schantz, et al, owned by the assignee of the present invention, by electrically charging ink drops in flight which impact on an electrostatic sensor to determine whether printheads are firing ink and the volume and or velocity of ink drops fired in bursts. The landing positions of the fired drops are not determinable by these techniques.

SUMMARY OF THE INVENTION

In one embodiment, the present invention provides a method of determining performance of a fluid ejection device, comprising:

- arranging said device relative to a sensor array of droplet detection transducers for projecting droplets from said device onto said array;
- projecting at least one droplet onto said array;
- detecting the outputs of each of said transducers to provide signals representative of fluid from said droplet on each of said transducers; and
- processing said signals to determine the size and/or position of said droplet.

Another embodiment of the invention provides a method of adjusting performance of a fluid ejection device in which droplets are projected from said device through space onto a target, comprising:

- arranging said device and target comprised of a droplet detecting array of fluid responsive transducers in relative position for projecting droplets from said device onto said array;
- projecting at least one droplet onto said array;
- detecting outputs of at least some of said transducers to provide signals representative of fluid from said droplet on said some of said transducers in said array; and
- using said signals to adjust the ejection of a subsequent droplet to impinge onto desired location on said target.

Various embodiments of a droplet detection device having a droplet reception surface comprising an array of spaced fluid responsive transducers are also disclosed, each transducer being capable of providing a signal indicative of presence of fluid from a droplet thereon.

BRIEF DESCRIPTION OF THE DRAWINGS

FIG. 3 is a schematic representation of one example of a transducer array and method of determining size and position of a droplet on said array from signals derived from the fluid sensing transducers.

DETAILED DESCRIPTION OF THE PREFERRED EMBODIMENT

Figure 1:
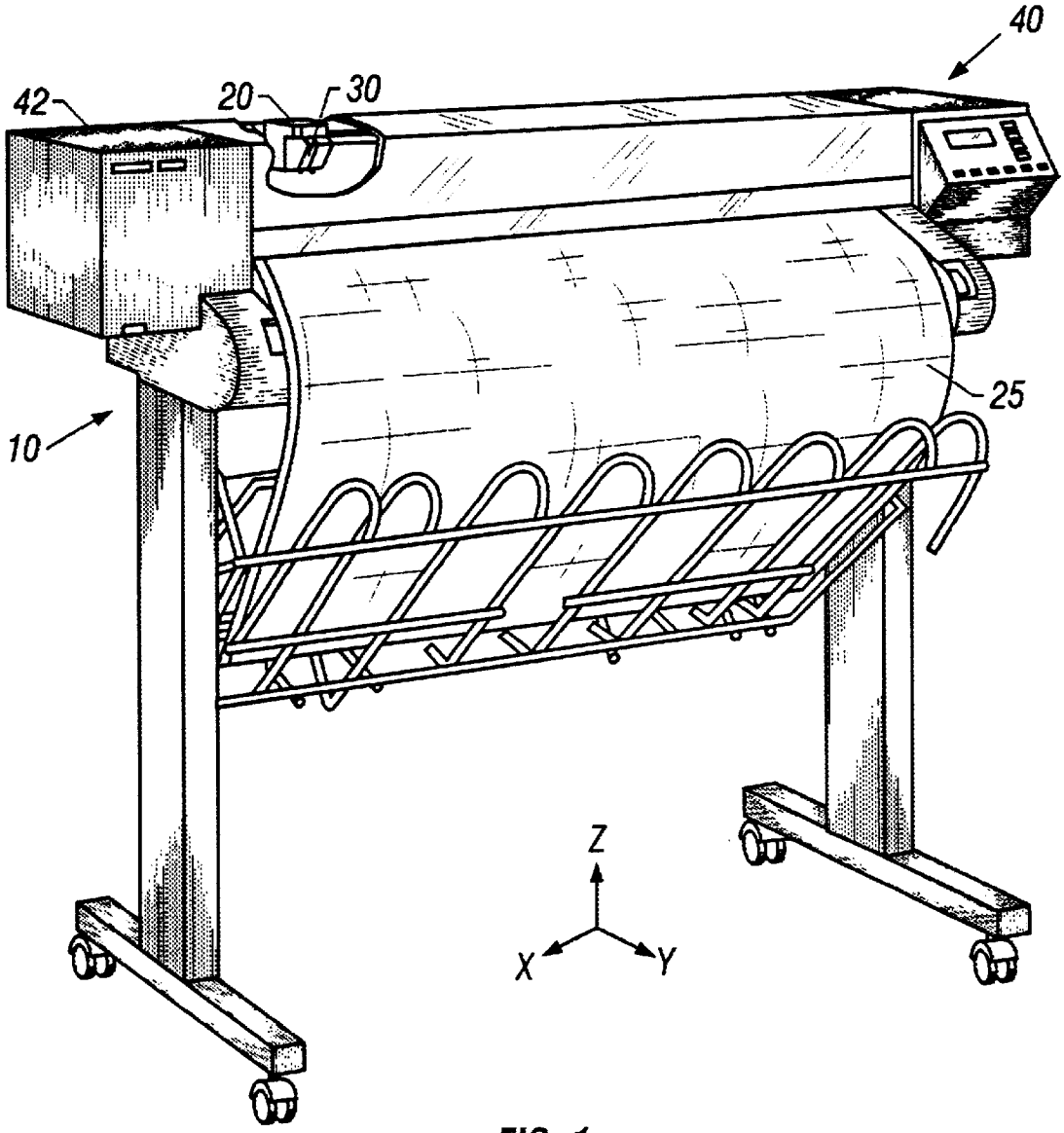
FIG. 1 is a perspective view of one form of an inkjet printing mechanism here shown as a wide format scanning inkjet plotter in which a droplet detection system constructed as disclosed herein may be used.

One form of an inkjet printing system, here shown as a wide format plotter or printer 10 which employs a scanning printhead carriage 20 on which at least one and usually four or more (only two are shown) inkjet printheads 30 are mounted is depicted in FIG. 1 for printing onto media 25. The carriage 20 in turn is mounted on transversely extending rods or bars (not shown) and may be laterally driven back and forth in the X direction by mechanisms well known in the art over rollfeed media which moves in the Y direction onto which printing takes place by inkjet printheads ejecting ink droplets in the negative Z direction. In the exemplary type of printer depicted which is shown in more detail in U.S. Pat. No. 5,342,133 owned by the current assignee of the subject matter disclosed herein, a printhead service station 40 may be positioned laterally to one side or the other of the media path (at the right side of the printer as shown). An offboard ink supply station 42 may be provided at the other side containing supplies of ink for replenishing ink used during printing from the carriage borne printheads 30 in this "off-axis" type of ink delivery system. Alternatively, other ink delivery systems may be used such as those having replaceable inkjet cartridges. The printhead carriage 20 and printheads 30 mounted thereon therefore may be parked at the service station 40 so that microscopic fluid ejection orifices in the printheads can be serviced by wiping, cleaning, spitting or priming as desired. Printhead servicing equipment such as wipers and caps may be mounted on a moveable sled (not shown) at the service station 40 so that the sled and servicing equipment may be moved toward and away from the parked carriage 20 and printheads 30 for servicing and/or maintaining the printheads in a moist condition during periods when the printer is not engaged in printing.

Figure 2:
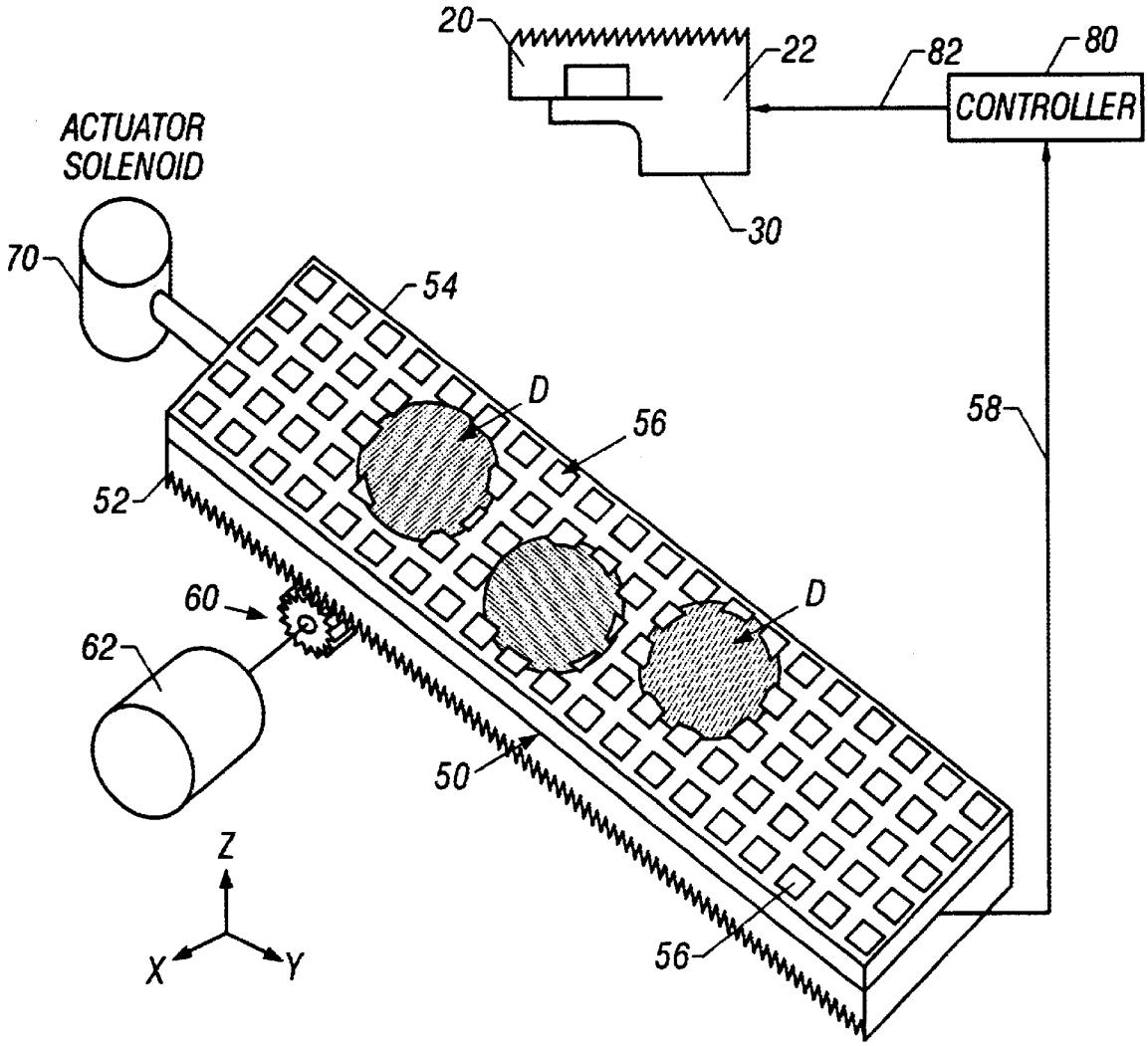
FIG. 2 is a perspective view of one embodiment of a drop sensor panel including an array of fluid sensing transducers and a schematic depiction of control of a fluid ejection device.

FIG. 2 comprises a partial block diagram and partial perspective view of one embodiment of a droplet sensor panel 50 which includes a semiconductor substrate 52 having an insulating layer 54 and an array of fluid responsive elements or transducers 56 formed in or on the insulating layer 54 each capable of detecting fluid such as ink from droplets D projected onto the droplet reception surfaces of the transducers 56. Each transducer 56 provides an electrical, optical or other type of output signal depicted at 58 representative of the amount of fluid on the fluid responsive surface of the transducer 56. As used herein, the term "fluid" is meant to broadly encompass liquids, gases, particulate solids and any other readily flowable materials which may be deposited onto the sensor panel 50.

FIG. 2 also schematically shows, by means of example and not limitation, two examples of actuators which each may be used to move the sensor panel between inoperative and operative positions. The first is a rack and pinion gear mechanism 60 driven by a motor and gear assembly 62 and the second is a solenoid linear actuator 70 operatively coupled to the panel 50. The transducers 56 may each be coupled to a circuit, schematically shown in FIG. 2, to provide signals 58 to with a printer controller 80 or some other controlling device which in turn generates firing signals at 82 for controlling the fluid ejection device such as a printhead 30 on a carriage 20.

Various types of fluid sensing elements are known in the art of micro electrical mechanical systems (MEMS) technology including, but not necessarily limited to, transducer elements in which electrical impedance changes in accordance with the temperature, moisture or pressure on the sensing surface of the transducer element. Transducers comprised of flexible micro-cantilevers or micro-beams which provide a variable frequency response caused by the presence of fluid impinging on the sensing surface are also well known in MEMS technology and can also be used as the fluid droplet sensing elements in the present invention as can any other fluid responsive elements which provide digital or analog signals in response to the presence of fluid from droplets D on the element.

The size and spacing of the transducers 56 in the array on the sensor panel 50 is not particularly critical so long as they can be manufactured with the necessary precision in size and spacing on a suitable insulating layer or directly on a suitable substrate. Preferably, the size and spacing of the transducers 56 should be smaller than the expected area of the deposited ink droplets D so that each droplet D can be expected to contact the fluid receiving surfaces of multiple transducers 56. If the shape of the droplet is approximately known, its position and size can be calculated with much higher accuracy than the resolution of the individual transducers 56 by fitting data derived from the transducer output signals to the expected shape. In general, a circle placed on a pixel grid can be located to an accuracy greater than the resolution of the pixel grid by fitting an ideal circle to the pixels that intersect the circle based on grayscale pixel values. Using such methods, the location accuracy can be enhanced in approximate proportion to the square root of the number of graylevels per pixel.

FIG. 3 shows one example of a transducer array comprised of 25 transducers each capable of providing a digital or analog output signal representative of the presence of fluid such as ink on the transducer surface. Each transducer provides an output signal generally representative of the proportionate area of the transducer surface covered by fluid ranging in value, commonly referred to as grayscale value, of from 0 to 255. The area of the droplet or spot, in square pixels, covered by fluid on the array is determined by summing the grayscale output values and dividing, in the example, by 255. The X and Y coordinates, in a rectangular coordinate system, of the centroid of the droplet or spot is determined by calculating a weighted average of the outputs of transducers as shown. Those skilled in the art will appreciate that the methodology depicted in FIG. 3 is by way of example only and that alternative methods employing non-rectangular coordinate systems, and/or other weighting techniques and grayscale values are well within the teachings of the invention.

It is contemplated that transducer sizes and spacings ranging from $0.1\mu$ to 10 mm may be particularly useful, depending on the characteristics of the ejected droplets D. It should be further noted that although the individual transducers 56 are shown with a square configuration in FIGS. 2 and 3, the shape of the transducers 56 need not be square and may be selected to suit the intended application. For example, round, rectangular or other polygonal or curved droplet reception surfaces may be preferred for individual implementations. Also, the transducers 56 need not be arranged in a geometrically repeating pattern on the surface of the sensor panel 50, although a geometrically repeating pattern is ordinarily preferred. The repeating pattern can, of course, be one of rows/columns as shown in FIGS. 2 and 3 or the transducers 56 may be arranged in triangular or other polygonal spacing or in circles or other regular, irregular or even random patterns considered advantageous depending on the nature of the application. It should be further noted that although FIG. 2 shows a sensor panel 50 with a limited number of transducers 56 forming an array of a specific configuration and in a specific relationship with respect to the size of the deposited micro-droplets D, the appearance of the sensor panel 50 in FIG. 2 is merely exemplary and is in no way intended to limit the type, number, shape, size or configuration of transducers 56 which may be used.

When one or more sensor panels 50 as described above are used in conjunction with an inkjet printer, it is contemplated that a sensor panel or panels 50 will be located in the vicinity of the printhead service station 40 for scanning or reciprocating inkjet printers and that the panel or panels 50 having an array or arrays of transducers 56 thereon can be brought into operative position relative to the ink ejection orifices of the inkjet printheads 30 (or other fluid ejection device) by moving printhead carriage 30 to the service station 40 or other location where the sensor panel or panels 50 are positioned. Alternatively, the panel(s) 50 may be placed in an operative position by moving a service station sled or support on which the sensor panel or panels 50 are mounted into operative position relative to the inkjet printhead(s) 30 or other fluid ejection device to be tested. For inkjet printers or other devices using non-movable inkjet printheads or pens such as a PWA printer, the sensor panel or panels 50 may be mounted on a moveable sled or other support to bring them into operative proximity with the stationary printhead or printheads so that printer performance may be periodically determined by sensing the size and/or position of ejected fluid droplets D on the various transducers 56.

A wiper (not shown) or some other cleaning or drying device can, of course, also be used to clean or "reset" the sensor transducers 56 at desired servicing intervals. The droplet reception surface of the sensor panel 50 may be appropriately configured to optimize performance attributes such as wetting angle and durability over multiple uses and cleanings of the transducers 56. For example, the sensing surfaces of the individual transducers 56 may be flush with, recessed below or protruding above the surface of the insulating layer 54. The sensor panel 50 may be made of or coated with passivation layers such as oxides or other semiconductor materials to achieve a specific interaction with the fluids being measured.

Since the presence of ink on the surfaces of the transducers varies the output signals produced by the individual transducers 56 within the matrix and hence the output signal 58, it is possible to determine both the size and/or landing position of the droplets D by methods as previously described. Data representative of desired droplet size may be stored and compared with data derived from the signal output 58 of the transducers 56 in the sensor panel 50 to develop error data useful in the controller 80 for example to control firing of the inkjet printheads 30 to eliminate the error. The panel 50 may also be useful for simply detecting the mere presence or absence of an ink droplet, for instance, when conducting a thermal turn-on energy (TTOE) establishment routine, where the firing signal is adjusted for the lowest energy at which droplets are ejected to conserve energy during printing.

Flight trajectory of droplets from the ejection device to the sensor panel may be determined and adjusted by comparing data representative of the actual landing position of the droplets D on the panel 50 with stored data representative of desired droplet position to develop error correction signals for controlling printhead firing. Finally, it should be apparent to those skilled in the art that one or more sensor panels 50 can be used when deemed advantageous and that identical or different types of transducers may be used on the same or different panels 50 which may have flat, curved or otherwise configured droplet reception surfaces and that the droplet reception surfaces of the sensor panels 50 need not occupy the same plane.

Persons skilled in the art will also appreciate that various additional modifications can be made to the preferred embodiments shown and described above and that the scope of protection is limited only by the wording of the claims which follow.

What is claimed is:

1. A method of determining performance of a fluid ejection device comprising:

arranging said device relative to a sensor array of droplet detection transducers for projecting droplets from said device onto said array;

projecting at least one droplet onto said array;

detecting outputs of each of said transducers to provide signals representative of fluid from said droplet on each of said transducers;

processing said signals to determine the size of said droplet, storing data representative of desired droplet size, comparing said stored data with data representative of determined size of said droplet to provide a device firing control signal, and using said device firing control signal to control the firing of droplets from said device, wherein said device and said array are arranged in operative position by moving said array toward said device.

2. A method according to claim 1, wherein said signals include electrical signals representative of the amount of fluid on individual ones of said transducers.

3. A method according to claim 2, wherein said detecting comprises determining electrical impedance of at least some of said transducers.

4. A method according to claim 1, wherein said detecting comprises determining temperature of at least some of said transducers.

5. A method according to claim 1, wherein said detecting comprises determining frequency response of at least some of said transducers.

6. A method according to claim 1, wherein said signals include optical signals representative of the presence of fluid on individual ones of said transducers.

7. A method according to claim 1, wherein said fluid ejection device is an inkjet printhead.

8. A method of determining performance of a fluid ejection device in which droplets are projected from said device through space, comprising:

arranging said device and a droplet detecting array of transducers in relative position for projecting droplets from said device onto said array;

projecting at least one droplet onto said array;

detecting outputs of each of said transducers to provide signals representative of fluid from said droplet on each transducer in said array; and processing said signals to determine the position on said array of said droplet, wherein said device and said array are arranged in operative position by moving said array toward said device.

9. A method according to claim 8, wherein said signals include electrical signals representative of the presence of fluid on individual ones of said transducers.

10. A method according to claim 8, wherein said signals include optical signals representative of the presence of fluid on individual ones of said transducers.

11. A method according to claim 8, including storing data representative of desired droplet size, comparing said stored data with said determined size of said droplet to provide a device firing control signal, and using said device firing control signal to control the firing of droplets from said device.

12. A method according to claim 8, including storing data representative of desired droplet position, comparing said stored data with said determined position of said droplet to provide a device firing control signal, and using said device firing control signal to adjust the trajectory of droplets ejected from said device.

13. A method according to claim 8, wherein said device and said array are arranged in operative position by moving said device toward said array.

14. A method according to claim 8, wherein said detecting comprises determining electrical impedance of at least some of said transducers.

15. A method according to claim 8, wherein said detecting comprises determining temperature of at least some of said transducers.

16. A method according to claim 8, wherein said detecting comprises determining frequency response of at least some of said transducers.

17. A method according to claim 8, wherein said fluid ejection device is an inkjet printhead.

18. A method of adjusting performance of a fluid ejection device in which droplets are projected from said device through space onto a target, comprising:

arranging said device and target comprised of a droplet detecting array of fluid responsive transducers in relative position for projecting droplets from said device onto said array;

projecting at least one droplet onto said array;

detecting outputs of at least some of said transducers to provide signals representative of fluid from said droplet on said some of said transducers in said array;

storing data representative of desired droplet position, comparing said stored data with said determined position of said droplet to provide a device firing control signal;

using said device firing control signal to adjust the trajectory of droplets ejected from said device, wherein said device and said array are arranged in operative position by moving said array toward said device.

19. A method according to claim 18, wherein said detecting comprises determining temperature of at least some of said transducers.

20. A method according to claim 18, wherein said detecting comprises determining temperature of at least some of said transducers.

21. A method according to claim 18, wherein said detecting comprises determining frequency response of at least some of said transducers.

22. A method according to claim 18, wherein said fluid ejection device is an inkjet printhead.

* * * * *